US009536497B2

(12) United States Patent
Zhang et al.

(10) Patent No.: US 9,536,497 B2
(45) Date of Patent: Jan. 3, 2017

(54) GAMMA VOLTAGE DRIVING CIRCUIT, SOURCE DRIVING MODULE, AND LIQUID CRYSTAL PANEL

(71) Applicant: Shenzhen China Star Optoelectronics Technology Co., Ltd., Shenzhen, Guangdong (CN)

(72) Inventors: Hua Zhang, Shenzhen (CN); Xueliang Yang, Shenzhen (CN)

(73) Assignee: Shenzhen China Star Optoelectronics Technology, Co., Ltd, Shenzhen, Guangdong (CN)

( * ) Notice: Subject to any disclaimer, the term of this patent is extended or adjusted under 35 U.S.C. 154(b) by 171 days.

(21) Appl. No.: 14/232,609

(22) PCT Filed: Dec. 9, 2013

(86) PCT No.: PCT/CN2013/088847
§ 371 (c)(1),
(2) Date: Jan. 13, 2014

(87) PCT Pub. No.: WO2015/081578
PCT Pub. Date: Jun. 11, 2015

(65) Prior Publication Data

US 2015/0154938 A1 Jun. 4, 2015

(30) Foreign Application Priority Data

Dec. 2, 2013 (CN) ..... 2013 1 0637440

(51) Int. Cl.
*G09G 3/36* (2006.01)
*G09G 5/10* (2006.01)

(52) U.S. Cl.
CPC *G09G 5/10* (2013.01); *G09G 3/36* (2013.01); *G09G 3/3622* (2013.01);
(Continued)

(58) Field of Classification Search
CPC . G09G 5/10; G09G 3/3696; G09G 2300/0404
(Continued)

(56) References Cited

U.S. PATENT DOCUMENTS

2002/0036609 A1* 3/2002 Kajihara ..... G09G 3/2011 345/87
2009/0207062 A1* 8/2009 Tsai ..... G09G 3/3688 341/144

(Continued)

*Primary Examiner* — Chanh Nguyen
*Assistant Examiner* — Daniel Duong
(74) *Attorney, Agent, or Firm* — Andrew C. Cheng

(57) ABSTRACT

The present invention discloses a Gamma voltage driving circuit, which comprises a voltage dividing resistor string, which comprises $2^n$ resistors connected in series sequentially, used to divide a reference voltage into $2^n$ Gamma voltages; wherein, n is an integer not less than 1; a reference voltage module, which provides the reference voltage for the voltage dividing resistor string; a voltage selecting module, which is used to selectively output one of the $2^n$ Gamma voltages. The reference voltage module comprises a first reference voltage and a second reference voltage, the first reference voltage is coupled to one end of the voltage dividing resistor string, the second reference voltage is coupled between the $2^n/2$-th resistor and the $(2^n/2+1)$-th resistor; wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units.

20 Claims, 3 Drawing Sheets

(52) U.S. Cl.
CPC ..... *G09G 3/3692* (2013.01); *G09G 3/3696* (2013.01); *G09G 2300/0404* (2013.01); *G09G 2320/0276* (2013.01); *G09G 2320/0673* (2013.01)

(58) Field of Classification Search
USPC ..... 345/690, 83, 94, 212
See application file for complete search history.

(56) References Cited

U.S. PATENT DOCUMENTS

| | | | | |
|---|---|---|---|---|
| 2012/0098818 | A1* | 4/2012 | Yoon | G09G 3/2007 345/212 |
| 2013/0271505 | A1* | 10/2013 | Min | G09G 3/3233 345/690 |
| 2014/0368562 | A1* | 12/2014 | Kim | G09G 3/3614 345/694 |

* cited by examiner

GAMMA VOLTAGE DRIVING CIRCUIT, SOURCE DRIVING MODULE, AND LIQUID CRYSTAL PANEL

BACKGROUND OF THE INVENTION

1. Field of the Invention

The present invention relates to the technology fields of liquid crystal display, and in particular to a gamma voltage driving circuit, a source driving module, and a liquid crystal panel comprising the source driving module in the liquid crystal display.

2. The Related Arts

Liquid crystal display (LCD) is a flat and thin display device. It is consisted of color or monochrome pixels with a certain amount, which is placed in front of the light source or the reflector. Liquid crystal display has low power consumption, high image quality, small size, and light weight, so it is favored to become the mainstream of display. The existing liquid crystal display is mainly thin film transistor (TFT) liquid crystal display, and the liquid crystal panel is the main component of the liquid crystal display.

FIG. 1 is a schematic view illustrating the structure of a liquid crystal panel, which comprises an upper glass substrate 1, a down glass substrate 2, and a liquid crystal layer 3 between the upper glass substrate 1 and the down glass substrate 2. One side of the liquid crystal layer 3 is provided with an ITO common electrode 4. The ITO common electrode 4 is connected to the Vcom voltage. The other side of the liquid crystal layer 3 is provided with multiple pixel electrodes 5. Each pixel electrode is connected to a Gamma voltage. The Gamma voltage is used to control the display grayscale of the liquid crystal panel. The voltage difference between different Gamma voltages and the Vcom voltage results in different rotation angles of liquid crystal, which forms the brightness difference. That is, the Gamma voltage divides the changing process from white to black into $2^n$ equal parts.

For example, FIG. 2 is a Gamma voltage driving circuit according to the prior art, which comprises a reference voltage module 10, a voltage dividing resistor string 20, and a voltage selecting module 30. The circuit corresponds to 3 bit binary code, that is, the voltage dividing resistor string 20 divides the reference voltage into 8 Gamma voltage V1~V8 (divide the changing process from white to black into $2^3$ equal parts), the voltage selecting module 30 selectively outputs one of the Gamma voltage. The voltage selecting module 30 is consisted of multiple MOS transistors 301. In the 3 bit driving circuit, each transmission line of the Gamma voltage provides with three MOS transistor, which is total 8*3=24 MOS transistors. In FIG. 2, when it selectively outputs the Gamma voltage V8, the corresponding binary code is (111), the voltage selecting module 30 turns on the MOS transistors b2, b1, and b0, and then the Gamma voltage V8 connects to the output terminal. In the driving circuit, when it utilizes 10 bit binary code, as shown in FIG. 3, the voltage dividing resistor string 20 divides the reference voltage into 1024 Gamma voltages V1~V1024 (divide the changing process from white to black into $2^{10}$ equal parts), the voltage selecting module 30 totally needs 1024*10=10240 MOS transistors 301. A large number of MOS transistors increase the difficulty of the design of driver IC and the production process, which increases the costs.

SUMMARY OF THE INVENTION

In view of the lack of the prior art, an object of the present invention is to provide a Gamma voltage driving circuit, which can reduce the using amount of device, reduce the difficulty of the design of driver IC and the production process, and save the costs.

In order to achieve the above object, the embodiment according to the present invention adopts the following technical solution:

a Gamma voltage driving circuit, used to generate multiple Gamma voltages, comprising:

a voltage dividing resistor string, which comprises $2^n$ resistors connected in series sequentially, used to divide a reference voltage into $2^n$ Gamma voltages; wherein, n is an integer not less than 1;

a reference voltage module, which provides reference voltage for the voltage dividing resistor string;

a voltage selecting module, which is used to selectively output one of the $2^n$ Gamma voltages;

characterized in that, the reference voltage module comprises a first reference voltage and a second reference voltage, the first reference voltage is coupled to one end of the voltage dividing resistor string, the other end of the voltage dividing resistor string is connected to the ground; the second reference voltage is coupled between the $2^n/2$-th resistor and the $(2^n/2+1)$-th resistor, wherein, the value of the second reference voltage is ½ of that of the first reference voltage;

wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units.

Wherein, in the voltage dividing resistor string, the first to $(2^n/2-1)$-th resistors divide the voltage value between the first reference voltage and the second reference voltage into $2^n/2$ Gamma voltages; the $(2^n/2+1)$-th to $2^n$-th resistors divide the voltage value between the second reference voltage and the ground voltage into $2^n/2$ Gamma voltages.

Wherein, the $2^n$ resistors are equivalent resistance.

Wherein, the driving circuit further comprises a control module, which is used to provide a control signal and a selecting signal for the voltage selecting module; when the voltage selecting module receives a first control signal and the selecting signal, the selecting signal controls the n−1 switching units on the transmission lines of the first to $(2^n/2-1)$-th resistors to be turned on or off, which selects one of Gamma voltages to connect to the output terminal; when the voltage selecting module receives a second control signal and the selecting signal, the selecting signal controls the n−1 switching units on the transmission lines of the $(2^n/2+1)$-th to $2^n$-th resistors to be turned on or off, which selects one of Gamma voltages to connect to the output terminal.

Wherein, in the reference voltage module, the first reference voltage is connected to the ground through a first voltage dividing resistor and a second voltage dividing resistor which are connected in series, the second reference voltage is connected between the first voltage dividing resistor and the second voltage dividing resistor, the resistance values of the first voltage dividing resistor and the second voltage dividing resistor are equal.

Wherein, the switching units are MOS transistors.

Wherein, n is a value of 10.

The another object of the present invention is to provide a source driving module, which drives a pixel array unit, the pixel array unit comprising a first pixel unit, a second pixel unit, and a third pixel unit, which correspondingly provides with a first pixel electrode, a second pixel electrode, and a third pixel electrode, the source driving module comprising a first Gamma voltage driving circuit, a second Gamma voltage driving circuit, and a third Gamma voltage driving circuit, which respectively provide Gamma voltage for the first pixel electrode, the second pixel electrode, and the third pixel electrode, wherein, the Gamma voltage driving circuit is the driving circuit mentioned above.

The another object of the present invention is to provide a liquid crystal panel, comprising:

a pixel array unit, which comprises a first pixel unit, a second pixel unit, and a third pixel unit corresponding to a first color, a second color, and a third color, the pixel array unit correspondingly providing with a first pixel electrode, a second pixel electrode, and a third pixel electrode;

a gate driving module, which provides a scanning signal for the pixel array unit; a source driving module, which provides a data signal for the pixel array unit;

wherein, the source driving module is the source driving module mentioned above.

Comparing with the prior art, the Gamma voltage driving circuit according to the present invention can reduce the using amount of device, reduce the difficulty of the design of driver IC and the production process, and save the costs.

DETAILED DESCRIPTION OF THE PREFERRED EMBODIMENTS

Figure 1:
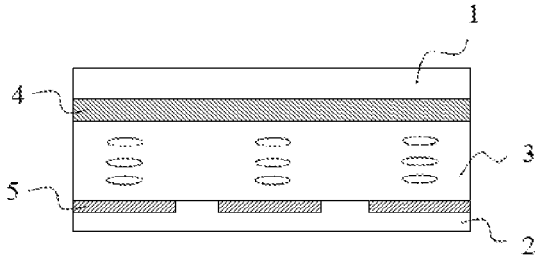
Figure 1 (Prior Art)
FIG. 1 is a schematic view illustrating the structure of a liquid crystal panel.
Figure 2:
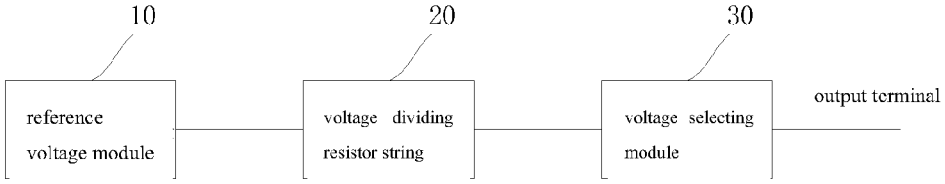
Figure 2 (Prior Art)
FIG. 2 is a schematic view illustrating a Gamma voltage driving circuit connecting the module according to the prior art.
Figure 3:
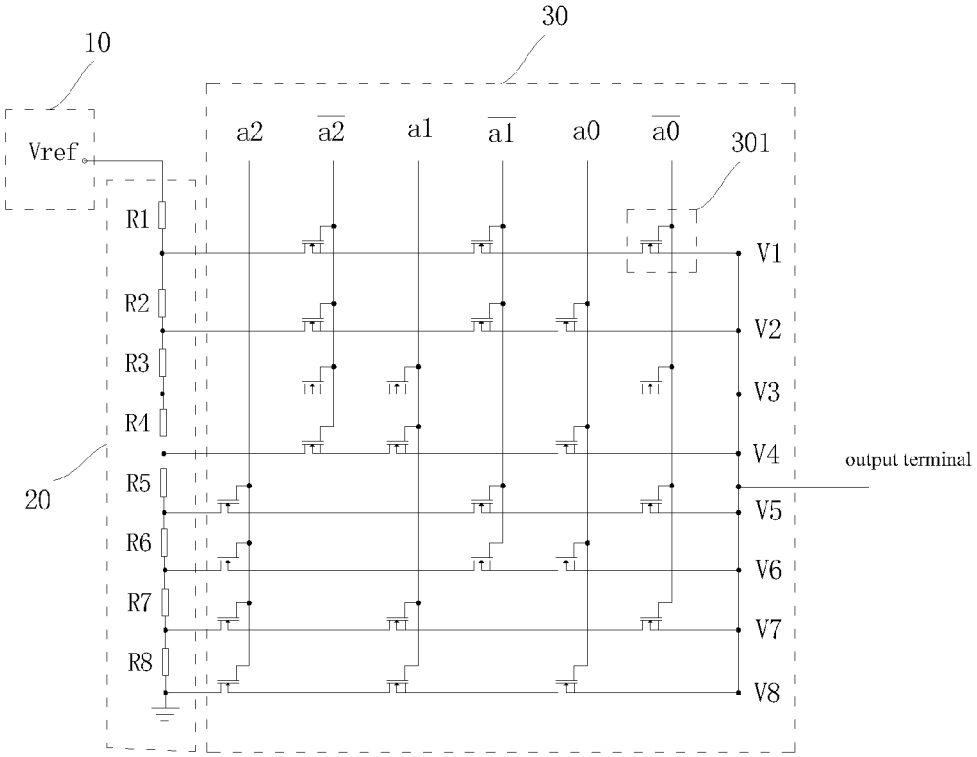
Figure 3 (Prior Art)
FIG. 3 is the circuit diagram of a Gamma voltage driving circuit according to the prior art, wherein the circuit can be divided into 8 Gamma voltages by the reference voltage.
Figure 4:
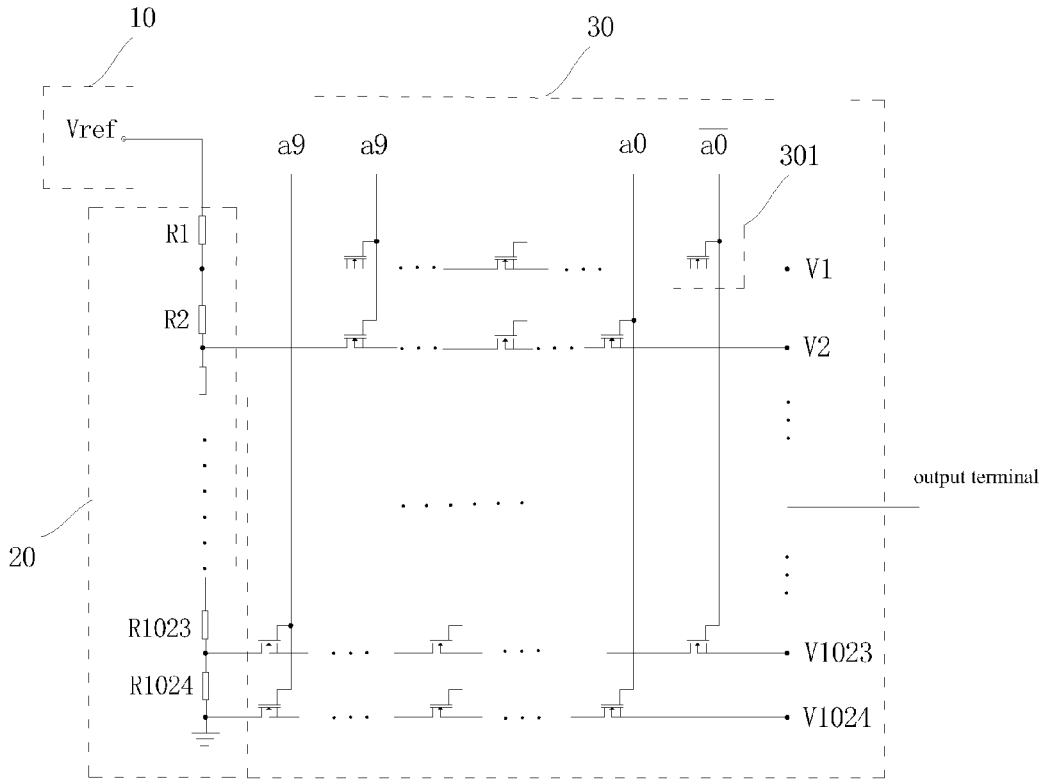
FIG. 4 is the circuit diagram of a Gamma voltage driving circuit according to the prior art, wherein the circuit can be divided into 1024 Gamma voltages by the reference voltage.

As mentioned above, in order to solve the existing problems of the prior art, the present invention provides a Gamma voltage driving circuit, which comprises: a voltage dividing resistor string, which comprises $2^n$ resistors connected in series sequentially, used to divide a reference voltage into $2^n$ Gamma voltages; wherein, n is an integer not less than 1; a reference voltage module, which provides the reference voltage for the voltage dividing resistor string; a voltage selecting module, which is used to selectively output one of the $2^n$ Gamma voltages.

Wherein, the reference voltage module comprises a first reference voltage and a second reference voltage, the first reference voltage is coupled to one end of the voltage dividing resistor string, the other end of the voltage dividing resistor string is connected to the ground; the second reference voltage is coupled between the $2^n/2$-th resistor and the $(2^n/2+1)$-th resistor, wherein, the value of the second reference voltage is ½ of that of the first reference voltage; wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units.

In the Gamma voltage driving circuit mentioned above, it provides two reference voltages. Set the first reference voltage as a starting point, the first to $(2^n/2-1)$-th resistors in the voltage dividing resistor string divide the voltage value between the first reference voltage and the second reference voltage into $2^n/2$ Gamma voltage. Therefore, each transmission line only needs n−1 switching units, which outputs one of the Gamma voltages every time according to the (n−1) bit binary coded method. The $(2^n/2+1)$-th to $2^n$-th resistors divide the voltage value between the second reference voltage and the ground voltage into $2^n/2$ Gamma voltages. Therefore, each transmission line only needs n−1 switching units, which outputs one of the Gamma voltages every time according to the (n−1) bit binary coded method. Moreover, in the Gamma voltage driving circuit with higher grayscale precision, the reference voltage needs to be divided into a lot of Gamma voltages. At this time, the two middle Gamma voltages (the voltages of the $2^n/2$-th and the $(2^n/2+1)$-th resistors) are nearly equal, so that they can share one of the Gamma voltage. In the present invention, it omits the Gamma voltage obtained from the $2^n/2$-th resistor, instead, it uses the Gamma voltage obtained from the $(2^n/2+1)$-th resistor, which further reduce the amount of the switch units. For the condition that the reference voltage needs to be divided into $2^n$ Gamma voltages, it needs $(2^n-1)*(n-1)$ switching units in the driving circuit according to the present invention, while it needs $2^n*n$ switching units in the Gamma voltage driving circuit according to the prior art. The reduced amount of the switching units is $2^n+(n-1)$.

According to the Gamma voltage driving circuit mentioned above, it can reduce the using amount of device, reduce the difficulty of the design of driver IC and the production process, and save the costs.

The embodiment of the present invention is further illustrated accompanying with the drawings as follows.

The present embodiment takes n=10 as example to illustrate. It should be noted that the technical solution of the present invention is not limited thereto.

Figure 5:
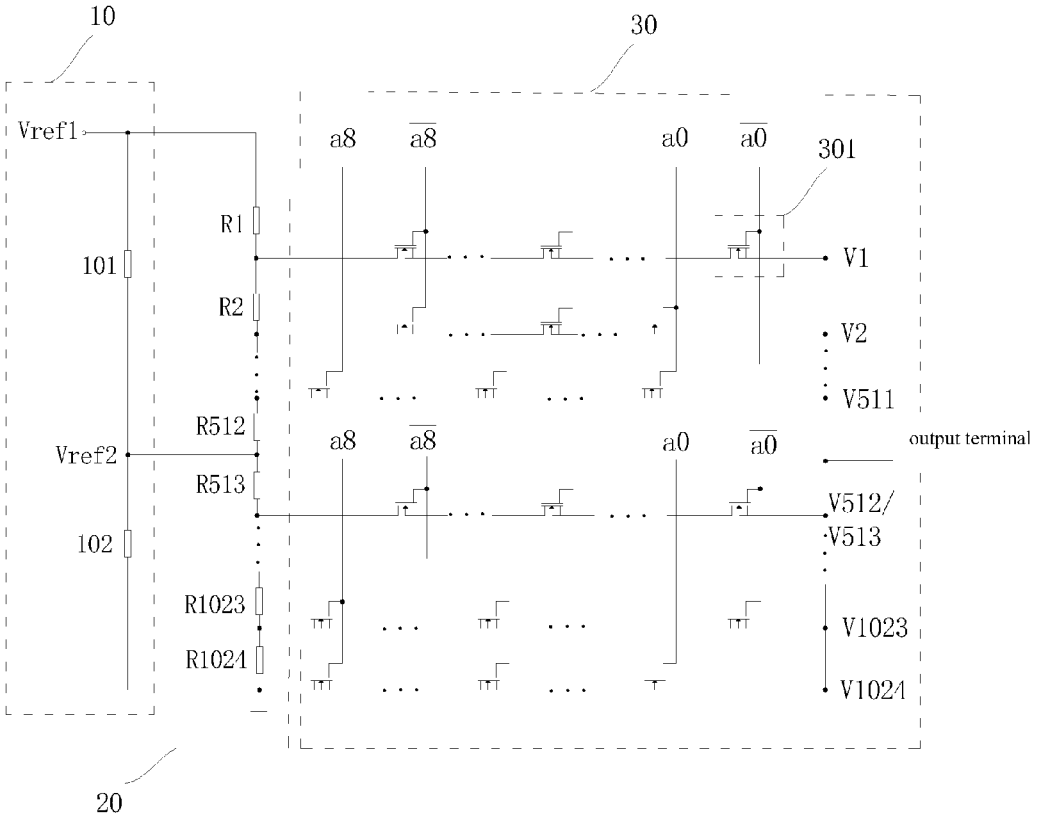
FIG. 5 is the circuit diagram of a Gamma voltage driving circuit according to an embodiment of the present invention.

Referring to FIG. 5, the Gamma voltage driving circuit according to the present embodiment comprises:

a reference voltage module 10, which provides reference voltage for the voltage dividing resistor string 20; a voltage dividing resistor string 20, which comprises 1024 resistors connected in series sequentially, used to divide a reference voltage into 1024 Gamma voltages; a voltage selecting module 30, which is used to selectively output one of the 1024 Gamma voltages;

wherein, the reference voltage module 10 comprises a first reference voltage Vref1 and a second reference voltage Vref2, the first reference voltage Vref1 is coupled to one end of the voltage dividing resistor string 20, the other end of the voltage dividing resistor string 20 is connected to the ground; the second reference voltage Vref2 is coupled between the 512-th resistor and the 513-th resistor in the voltage dividing resistor string 20, wherein, the Vref2=½Vref1;

wherein, the voltage selecting module 30 comprises 1023 transmission lines, which respectively connects the voltage dividing nodes of the first to 511-th resistors and the 513-th to 1024-th resistors in the voltage dividing resistor string 20 to a output terminal; and each transmission line is provided with 9 switching units 301; it should be noted that, in the present embodiment, the two middle Gamma voltages (the voltages of the 512-th and the 513-th resistors) are nearly equal, so they can share one of the Gamma voltage. In the present invention, it omits the Gamma voltage obtained from the 512-th resistor, that is, the Gamma voltage obtained from the 512-th resistor is not connected to the output terminal, instead, it uses the Gamma voltage obtained from the 513-th resistor, which further reduces the amount of the switch units.

In the present embodiment, the relationship of Vref2=½Vref1 is achieved through the two voltage dividing resistors 101 and 102. The first reference voltage Vref1 is connected to the first voltage dividing resistor 101, the second voltage dividing resistor 102 is connected with the first voltage dividing resistor 101 in series, the other end of the second voltage dividing resistor 102 is connected to the ground, the second reference voltage Vref2 is connected between the first voltage dividing resistor 101 and the second voltage dividing resistor 102, and the resistance value of the first voltage dividing resistor 101 and the second voltage dividing resistor 102 are equal, so that Vref2=½Vref1.

In the present embodiment, the 1024 resistors in the voltage dividing resistor string 20 are equivalent resistance. The switching units 301 connected on the transmission line are MOS transistors.

In the Gamma voltage driving circuit mentioned above, in the voltage dividing resistor string 20, set the first reference voltage Vref1 as a starting point, the first to 512-th resistors divide the voltage value between Vref1~Vref2 into 512 Gamma voltage; the 513-th to 1024-th resistors divide the voltage value between Vref2~V0 (V0 refers to ground voltage) into 512 Gamma voltage.

The Gamma voltage driving circuit according to the present embodiment further comprises a control module (not shown), which is used to provide a control signal and a selecting signal for the voltage selecting module 30. The control signal connects the selecting signal to the switching units between the first to the 512-th resistors or the switching units between the 513-th to the 1024-th resistors. The selecting signal controls the switching units to be turned on or off to select one of the Gamma voltages.

When the voltage selecting module 30 receives a first control signal, the selecting signal connects to the switching units 301 on the transmission lines of the first to 512-th resistors and controls the switching units 301 to be turned on or off, which selects one of the Gamma voltages formed from the first to 512-th resistors to connect to the output terminal; when the voltage selecting module 30 receives a second control signal, the selecting signal connects to the switching units 301 on the transmission lines of the 513-th to 1024-th resistors and controls the switching units 301 to be turned on or off, which selects one of the Gamma voltages formed from the 513-th to 1024-th resistors to connect to the output terminal.

On the transmission lines corresponding to the first to 512-th resistors, each switching unit has two states of turning on and off. All combinations of the switching units constitute 512 9 bit binary code, which exactly corresponds to 512 Gamma voltages V1~V512 sequentially. When the selecting signal corresponds to one binary code, it outputs a corresponding Gamma voltage. Similarly, on the transmission lines corresponding to the 513-th to 1024-th resistors, each switching unit has two states of turning on and off. All combinations of the switching units constitute 512 9 bit binary code, which exactly corresponds to 512 Gamma voltages V513~V1024 sequentially. When the selecting signal corresponds to one binary code, it outputs a corresponding Gamma voltage. It should be noted that, if the selecting signal corresponds to the V512, the control module connects to the corresponding transmission line of the 513-th resistor and outputs the V513 to the output terminal.

As mentioned above, in the condition of dividing the reference voltage into 1024 Gamma voltages, the driving circuit according to the present embodiment uses 1023 transmission lines. Each transmission line provides with 9 MOS transistors, which totally need 9207 MOS transistors. However, the Gamma voltage driving circuit according to the prior art needs 10240 MOS transistors, which reduces 1033 MOS transistors. According to the Gamma voltage driving circuit with higher grayscale precision, that is, n is a higher value, the technical solution according to the present invention has a greater advantage.

The present embodiment further provides a source driving module, which drives a pixel array unit, the pixel array unit comprising a first pixel unit, a second pixel unit, and a third pixel unit (corresponding to the color of red, green, and blue), which correspondingly provides with a first pixel electrode, a second pixel electrode, and a third pixel electrode, the source driving module comprising a first Gamma voltage driving circuit, a second Gamma voltage driving circuit, and a third Gamma voltage driving circuit, which respectively provide Gamma voltage for the first pixel electrode, the second pixel electrode, and the third pixel electrode, wherein, the Gamma voltage driving circuit is the driving circuit mentioned above.

The present embodiment further provides a liquid crystal panel, comprising:

a pixel array unit, which comprises a first pixel unit, a second pixel unit, and a third pixel unit corresponding to a first color, a second color, and a third color (red, green, and blue), the pixel array unit correspondingly providing with a first pixel electrode, a second pixel electrode, and a third pixel electrode;

a gate driving module, which provides a scanning signal for the pixel array unit;

a source driving module, which provides a data signal for the pixel array unit;

wherein, the source driving module is the source driving module mentioned above.

In summary, the Gamma voltage driving circuit according to the present invention can reduce the using amount of device, reduce the difficulty of the design of driver IC and the production process, and save the costs.

It needs to notice that, in this article, the relational terms such as first and second is only used to distinguish one entity or operating another entity or an operation, it is not necessary to require or imply that there exists any such relationship or sequence between the entity and operation. Besides, the terms "comprise," "include," or any other variation are intended to cover a non-exclusive inclusion, thereby making that comprising a series of process, method, materials or apparatus of element not only comprise those elements, but also comprise other elements not expressly listed, or also comprise such inherent elements of process, method, materials or apparatus. In the absence of more restrictive conditions, limiting the elements by the statement "comprises a . . . ", it doesn't exclude that it also exists other identical elements in comprising the process, method, materials or apparatus of element.

The preferred embodiments of the present invention have been described. It should be noted that, for those having ordinary skills in the art, any deduction or modification according to the present invention is considered encompassed in the scope of protection defined by the claims of the present invention.

What is claimed is:

1. A Gamma voltage driving circuit, used to generate multiple Gamma voltages, comprising:

a voltage dividing resistor string, which comprises $2^n$ resistors connected in series sequentially, used to divide a reference voltage into $2^n$ Gamma voltages; wherein, n is an integer not less than 1;

a reference voltage module, which provides reference voltage for the voltage dividing resistor string;

a voltage selecting module, which is used to selectively output one of the $2^n$ Gamma voltages;

wherein, the reference voltage module comprises a first reference voltage and a second reference voltage, the first reference voltage is coupled to one end of the voltage dividing resistor string, the other end of the voltage dividing resistor string is connected to the ground; the second reference voltage is coupled between the $2^n/2$-th resistor and the $(2^n/2+1)$-th resistor, wherein, the value of the second reference voltage is ½ of that of the first reference voltage;

wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units, wherein, the voltage dividing node between the $2^n/2$-th resistor and the $(2^n/2+1)$-th resistor is not directly connected to all the transmission lines.

2. The Gamma voltage driving circuit as claimed in claim 1, wherein, in the voltage dividing resistor string, the first to $(2^n/2-1)$-th resistors divide the voltage value between the first reference voltage and the second reference voltage into $2^n/2$ Gamma voltages; the $(2^n/2+1)$-th to $2^n$-th resistors divide the voltage value between the second reference voltage and the ground voltage into $2^n/2$ Gamma voltages.

3. The Gamma voltage driving circuit as claimed in claim 2, wherein the $2^n$ resistors are equivalent resistance.

4. The Gamma voltage driving circuit as claimed in claim 2, wherein the driving circuit further comprises a control module, which is used to provide a control signal and a selecting signal for the voltage selecting module; when the voltage selecting module receives a first control signal and the selecting signal, the selecting signal controls the n−1 switching units on the transmission lines of the first to $(2^n/2-1)$-th resistors to be turned on or off, which selects one of Gamma voltages to connect to the output terminal; when the voltage selecting module receives a second control signal and the selecting signal, the selecting signal controls the n−1 switching units on the transmission lines of the $(2^n/2+1)$-th to $2^n$-th resistors to be turned on or off, which selects one of Gamma voltages to connect to the output terminal.

5. The Gamma voltage driving circuit as claimed in claim 1, wherein, in the reference voltage module, the first reference voltage is connected to the ground through a first voltage dividing resistor and a second voltage dividing resistor which are connected in series, the second reference voltage is connected between the first voltage dividing resistor and the second voltage dividing resistor, the resistance values of the first voltage dividing resistor and the second voltage dividing resistor are equal.

6. The Gamma voltage driving circuit as claimed in claim 4, wherein, in the reference voltage module, the first reference voltage is connected to the ground through the first voltage dividing resistor and the second voltage dividing resistor which are connected in series, the second reference voltage is connected between the first voltage dividing resistor and the second voltage dividing resistor, the resistance values of the first voltage dividing resistor and the second voltage dividing resistor are equal.

7. The Gamma voltage driving circuit as claimed in claim 1, wherein the switching units are MOS transistors.

8. The Gamma voltage driving circuit as claimed in claim 7, wherein n is a value of 10.

9. A source driving module, which drives a pixel array unit, the pixel array unit comprising a first pixel unit, a second pixel unit, and a third pixel unit, which correspondingly provides with a first pixel electrode, a second pixel electrode, and a third pixel electrode, the source driving module comprising a first Gamma voltage driving circuit, a second Gamma voltage driving circuit, and a third Gamma voltage driving circuit, which respectively provide Gamma voltage for the first pixel electrode, the second pixel electrode, and the third pixel electrode, wherein the Gamma voltage driving circuit comprises:

a voltage dividing resistor string, which comprises $2^n$ resistors connected in series sequentially, used to divide a reference voltage into $2^n$ Gamma voltages; wherein, n is an integer not less than 1;

a reference voltage module, which provides reference voltage for the voltage dividing resistor string;

a voltage selecting module, which is used to selectively output one of the $2^n$ Gamma voltages;

wherein, the reference voltage module comprises a first reference voltage and a second reference voltage, the first reference voltage is coupled to one end of the voltage dividing resistor string, the other end of the voltage dividing resistor string is connected to the ground; the second reference voltage is coupled between the $2^n/2$-th resistor and the $(2^n/2+1)$-th resistor, wherein, the value of the second reference voltage is ½ of that of the first reference voltage;

wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units, wherein, the voltage dividing node between the $2^n/2$-th resistor and the $(2^n/2+1)$-th resistor is not directly connected to all the transmission lines.

10. The source driving module as claimed in claim 9, wherein, in the voltage dividing resistor string, the first to $(2^n/2-1)$-th resistors divide the voltage value between the first reference voltage and the second reference voltage into $2^n/2$ Gamma voltages; the $(2^n/2+1)$-th to $2^n$-th resistors divide the voltage value between the second reference voltage and the ground voltage into $2^n/2$ Gamma voltages.

11. The source driving module as claimed in claim 10, wherein the $2^n$ resistors are equivalent resistance.

12. The source driving module as claimed in claim 10, wherein the driving circuit further comprises a control module, which is used to provide a control signal and a selecting signal for the voltage selecting module; when the voltage selecting module receives a first control signal and the selecting signal, the selecting signal controls the n−1 switching units on the transmission lines of the first to $(2^n/2-1)$-th resistors to be turned on or off, which selects one of Gamma voltages to connect to the output terminal; when the voltage selecting module receives a second control signal and the selecting signal, the selecting signal controls the n−1 switching units on the transmission lines of the $(2^n/2+1)$-th to $2^n$-th resistors to be turned on or off, which selects one of Gamma voltages to connect to the output terminal.

13. The source driving module as claimed in claim 9, wherein, in the reference voltage module, the first reference voltage is connected to the ground through a first voltage dividing resistor and a second voltage dividing resistor which are connected in series, the second reference voltage is connected between the first voltage dividing resistor and the second voltage dividing resistor, the resistance values of the first voltage dividing resistor and the second voltage dividing resistor are equal.

14. The source driving module as claimed in claim 9, wherein the switching units are MOS transistors.

15. The source driving module as claimed in claim 14, wherein n is a value of 10.

16. A liquid crystal panel, comprising:

a pixel array unit, which comprises a first pixel unit, a second pixel unit, and a third pixel unit corresponding to a first color, a second color, and a third color, the pixel array unit correspondingly providing with a first pixel electrode, a second pixel electrode, and a third pixel electrode;

a gate driving module, which provides a scanning signal for the pixel array unit;

a source driving module, which provides a data signal for the pixel array unit; wherein, the source driving module comprising a first Gamma voltage driving circuit, a second Gamma voltage driving circuit, and a third Gamma voltage driving circuit, which respectively provide Gamma voltage for the first pixel electrode, the second pixel electrode, and the third pixel electrode, wherein the Gamma voltage driving circuit comprises:

a voltage dividing resistor string, which comprises $2^n$ resistors connected in series sequentially, used to divide a reference voltage into $2^n$ Gamma voltages; wherein, n is an integer not less than 1;

a reference voltage module, which provides reference voltage for the voltage dividing resistor string;

a voltage selecting module, which is used to selectively output one of the $2^n$ Gamma voltages;

wherein, the reference voltage module comprises a first reference voltage and a second reference voltage, the first reference voltage is coupled to one end of the voltage dividing resistor string, the other end of the voltage dividing resistor string is connected to the ground; the second reference voltage is coupled between the $2^n/2$-th resistor and the $(2^n/2+1)$-th resistor, wherein, the value of the second reference voltage is ½ of that of the first reference voltage;

wherein, the voltage selecting module comprises $2^n-1$ transmission lines, which respectively connects the voltage dividing nodes of the first to $(2^n/2-1)$-th resistors and the $(2^n/2+1)$-th to $2^n$-th resistors in the voltage dividing resistor string to a output terminal; and each transmission line is provided with n−1 switching units, wherein, the voltage dividing node between the $2^n/2$-th resistor and the $(2^n/2+1)$-th resistor is not directly connected to all the transmission lines.

17. The liquid crystal panel as claimed in claim 16, wherein, in the voltage dividing resistor string, the first to $(2^n/2-1)$-th resistors divide the voltage value between the first reference voltage and the second reference voltage into $2^n/2$ Gamma voltages; the $(2^n/2+1)$-th to $2^n$-th resistors divide the voltage value between the second reference voltage and the ground voltage into $2^n/2$ Gamma voltages; wherein, the $2^n$ resistors are equivalent resistance.

18. The liquid crystal panel as claimed in claim 17, wherein the driving circuit further comprises a control module, which is used to provide a control signal and a selecting signal for the voltage selecting module; when the voltage selecting module receives a first control signal and the selecting signal, the selecting signal controls the n−1 switching units on the transmission lines of the first to $(2^n/2-1)$-th resistors to be turned on or off, which selects one of Gamma voltages to connect to the output terminal; when the voltage selecting module receives a second control signal and the selecting signal, the selecting signal controls the n−1 switching units on the transmission lines of the $(2^n/2+1)$-th to $2^n$-th resistors to be turned on or off, which selects one of Gamma voltages to connect to the output terminal.

19. The liquid crystal panel as claimed in claim 16, wherein the switching units are MOS transistors.

20. The liquid crystal panel as claimed in claim 19, wherein n is a value of 10.

* * * * *